US008838175B2

(12) United States Patent
Zhang et al.

(10) Patent No.: US 8,838,175 B2
(45) Date of Patent: Sep. 16, 2014

(54) SIGNAL TRANSMISSION CHANNEL

(75) Inventors: Yaqiong Zhang, Singapore Science Park II (SG); Xiaobing Sun, Singapore Science Park II (SG); Yugang Ma, Singapore Science Park II (SG)

(73) Assignee: Sony Corporation, Tokyo (JP)

( * ) Notice: Subject to any disclaimer, the term of this patent is extended or adjusted under 35 U.S.C. 154(b) by 254 days.

(21) Appl. No.: 12/942,190

(22) Filed: Nov. 9, 2010

(65) Prior Publication Data

US 2011/0117836 A1 May 19, 2011

(30) Foreign Application Priority Data

Nov. 17, 2009 (SG) ..... 200907690-2

(51) Int. Cl.
*H04B 1/38* (2006.01)
*H01P 5/02* (2006.01)
*H01P 3/12* (2006.01)

(52) U.S. Cl.
CPC ..... *H01P 3/121* (2013.01); *H01P 5/028* (2013.01)
USPC ..... 455/559; 455/327; 455/121

(58) Field of Classification Search
CPC ..... H04P 5/028; H04P 3/121; H04B 7/24
USPC ..... 455/559, 550.1, 121, 129, 327, 328, 455/329, 330, 331; 333/126, 127, 128, 129, 333/132, 134, 135
See application file for complete search history.

(56) References Cited

U.S. PATENT DOCUMENTS

2004/0246072 A1 * 12/2004 Hidaka et al. ..... 333/134
2009/0000106 A1 1/2009 Chuang et al.

FOREIGN PATENT DOCUMENTS

CN 1825683 8/2006
CN 201048157 4/2008
WO WO 2009116934 A1 * 9/2009 ..... H01P 3/12

OTHER PUBLICATIONS

Wei; Liquid crystal polymer (LCP) for microwave/millimeter wave multilayer packaging; Jul. 15, 2003; URL: htt;://ieexplore.ieee.or.
International Search Report issued on Mar. 28, 2012, in connection with counterpart Singapore Application No. 200907690-2.

* cited by examiner

*Primary Examiner* — Ping Hsieh
(74) *Attorney, Agent, or Firm* — Sony Corporation

(57) ABSTRACT

A signal transmission channel using a SIW between a transmitter and distant receiver. The SIW may include a MSL/SIW interface, be flexible, may use plug connections and/or may operate in a MMW band.

18 Claims, 4 Drawing Sheets

SIGNAL TRANSMISSION CHANNEL

FIELD OF THE INVENTION

The present invention relates to a signal transmission channel particularly though not solely to a flexible SIW signal transmission channel.

BACKGROUND

The following abbreviations may be used in this specification:

MSL Microstrip lines
CPW Coplanar waveguides
PCB Printed Circuits Board
MMW Millimeter-wave
SIW Substrate integrated waveguide
LCP Liquid-Crystal Polymer
TEM Transverse ElectroMagnetic There a various frequency bands in use for transmitting data. More recently the MMW band has become more popular because of free usage and high-bandwidth.

Conventional transmission lines, such as MSL and CPW, are used widely in planar PCB circuits. However, for MMW, MSL and CPW may suffer from high loss and interference with each other due to radiation. On the other hand, traditional metal waveguides may have lower insertion loss for MMW and low radiation. Unfortunately, the transition from traditional metal waveguide to integrated planar circuits may be complex and the metal waveguide may be bulky in size.

In order to achieve very compact planar circuits in MMW frequencies, a SIW has been used instead of traditional metal rectangular waveguides. Examples include MMW packaging, MMW SIW antennas and SIW filters.

SUMMARY OF THE INVENTION

In general terms, the invention proposes that a SIW be used as a signal transmission channel between a transmitter and distant receiver. The SIW may include a MSL/SIW interface, be flexible, may use plug connections and/or may operate in a MMW band. This may have one or more advantages including:

(1) there may be no radiation even with bending of the SIW;
(2) easy plugging in/out;
(3) improved field-matching between the MSL-SIW;
(4) several SIW can be put or stacked together closely without interference each other to build multiple parallel propagation channels;
(5) very wideband, low insertion loss, high performance, By using a flexible substrate, the whole SIW will be bendable;
(6) the SIW can be rigid as well as flexible according to different substrate material to be chosen;
(7) also other frequency band applications; and/or
(8) low manufacturing cost.

In a particular expression of the invention, there is provided a signal transmission channel as claimed in claim 1 or claim 2.

BRIEF DESCRIPTION OF THE DRAWINGS

One or more example embodiments of the invention will now be described, with reference to the following figures, in which.

DETAILED DESCRIPTION

Figure 1:
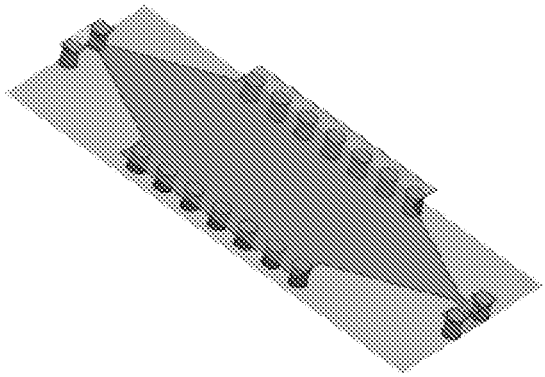
FIG. 1 is a schematic of a prior art SIW structure fabricated using a PCB process.
Figure 2:
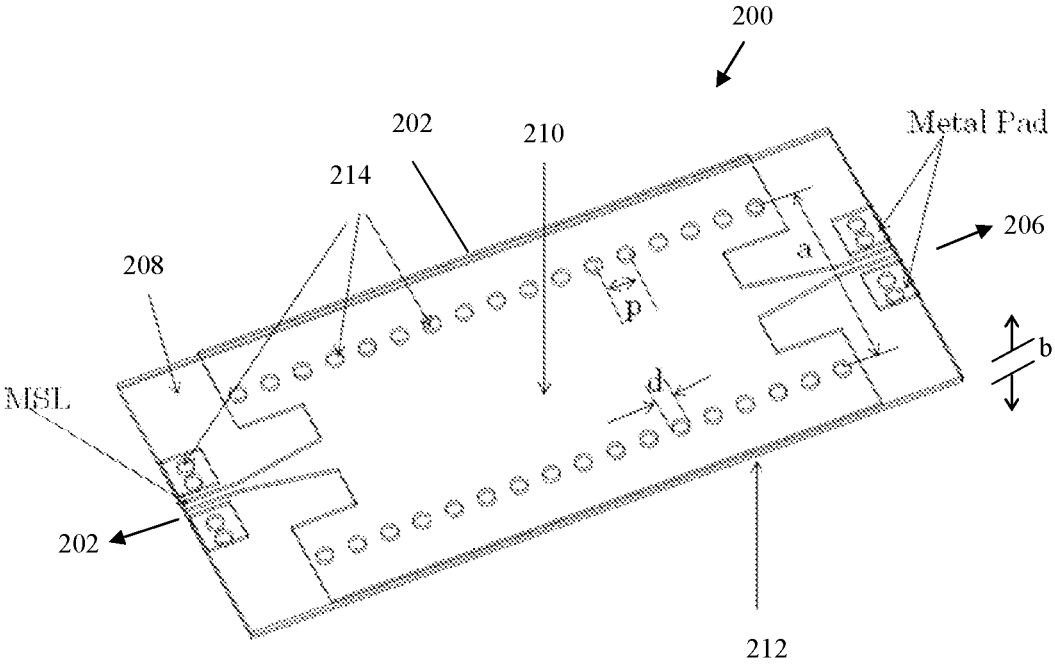
FIG. 2 is a schematic of a MSL-SIW-MSL MMW signal transmission channel according to a first example embodiment.

According to the first example embodiment 200, MMW signals may be transmitted using a SIW structure 202 as the signal transmission channel as shown in FIG. 2. A flexible SIW structure is the preferred format. The SIW structure 202 may be permanently connected as a signal transmission channel between a transmitter 204 and a receiver 206.

The SIW structure 202 includes substrate material 208, top metal layer 210, bottom metal layer 212 and two rows of periodic via-hole connections 214 between the two metal layers 210, 212 structure. The SIW 202 is effectively a quasi-rectangular waveguide with dielectric material. The size of the SIW structure 202 may be approximately determined using dielectric filled rectangular metal waveguide theory.

As shown in FIG. 2, the width between via-holes is 'a'. The diameter of the via-hole is 'd'. The separate length between two via-holes in one row is 'p'. The thickness of the substrate is 'b'. Therefore, the cut-off frequency of SIWs' modes can be calculated in Equation 1:

$$f_{Cmn} = \frac{1}{2\pi\sqrt{\mu\varepsilon}}\sqrt{\left(\frac{m\pi}{a}\right)^2 + \left(\frac{n\pi}{b}\right)^2} \tag{1}$$

'μ' and 'ϵ' are the substrate's 208 permittivity and permeability where n and m are indexes for the different modes in each plane.

There may be only $TE_{n0}$ modes in the SIW structure 202 and the dominant mode may be $TE_{10}$ mode. So the cut-off frequency of the dominant $TE_{10}$ mode may be calculated in Equation 2:

$$f_{Cmn} = \frac{1}{2a\sqrt{\mu\varepsilon}} \tag{2}$$

Thus the cut-off frequency of $TE_{10}$ mode may only be related to the width 'a' between via-holes. Thus the thickness 'b' of the substrate may not have much effect on $TE_{10}$ mode propagation in the SIW.

Typical design parameters to minimise the radiation loss and return loss in MMW are shown in Equation 3:

$$\frac{d}{p} \geq 0.5 \ \& \ \frac{d}{a} < 0.4 \tag{3}$$

The SIW may be fabricated on a flexible substrate, such as LCP, that may make the whole waveguide bendable and easy to use, for example Rogers 3003 or 4003. Various other materials are also possible depending on the application. The SIW may for example be 50-100 microns and 3 cm long.

Figure 3:
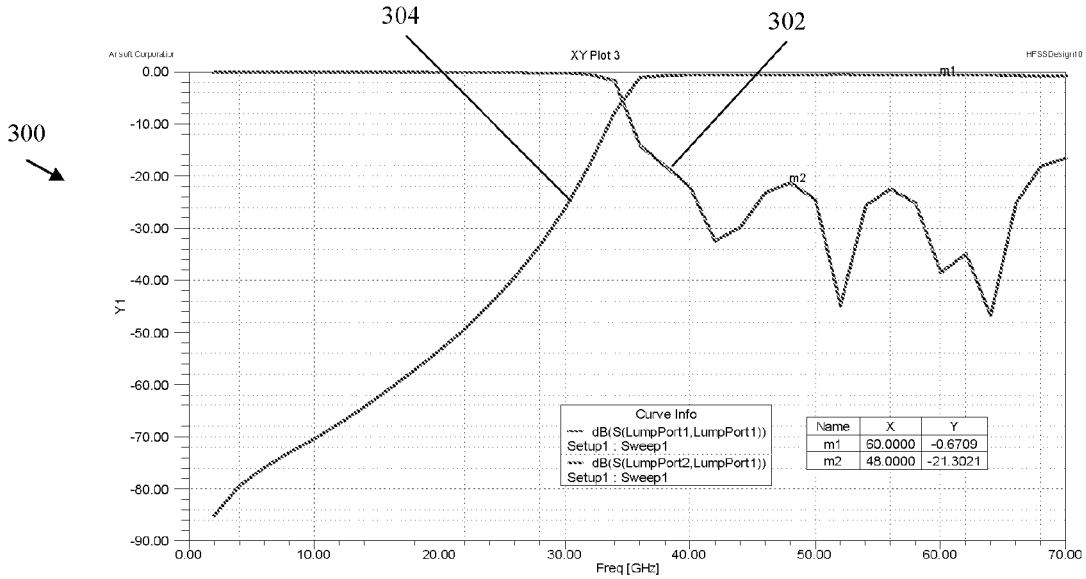
FIG. 3 is a graph of simulation results of the first example embodiment.

As shown in FIG. 3 the bandwidth 302 can be over several tens of GHz and the insertion loss 304 is less than 1 dB with total channel length equal to 8.8 mm.

Figure 4A:
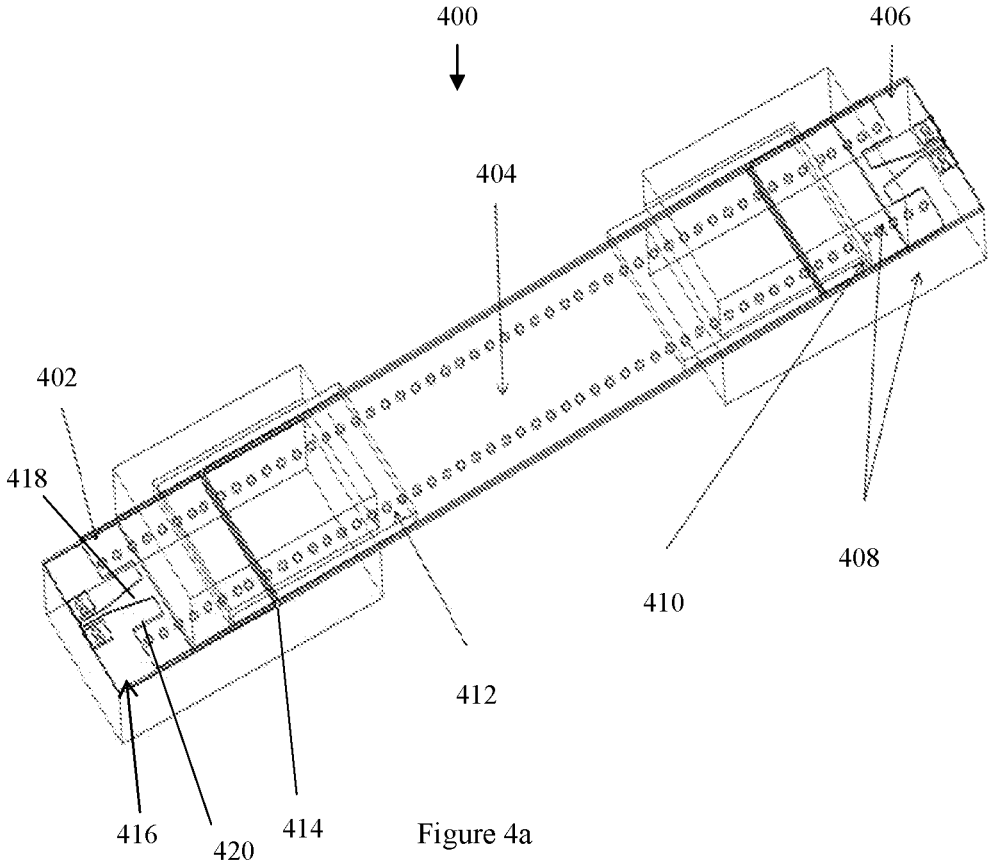
FIG. 4*a* is a schematic of a plug in/out SIW connector structure according to a second example embodiment.

According to the second example embodiment 400, an easy plug in/out connector is provided for the SIW structure as shown in FIG. 4*a*. Whereas the first example embodiment may be permanently connected to between a receiver and transmitter, the second example embodiment allows for the SIW to be disconnected and reconnected.

In the second example embodiment the SIW 400 has three separate parts: head1 402, middle 404 and head2 406. The head1 402 and head2 406 are each permanently attached to a transmitter or receiver, separately. The middle 404 is chosen as an appropriate length to connect between head1 402 and head2 406. When the middle 404 is in place and connected, the transmission channel can be established again conveniently.

Figure 4B:
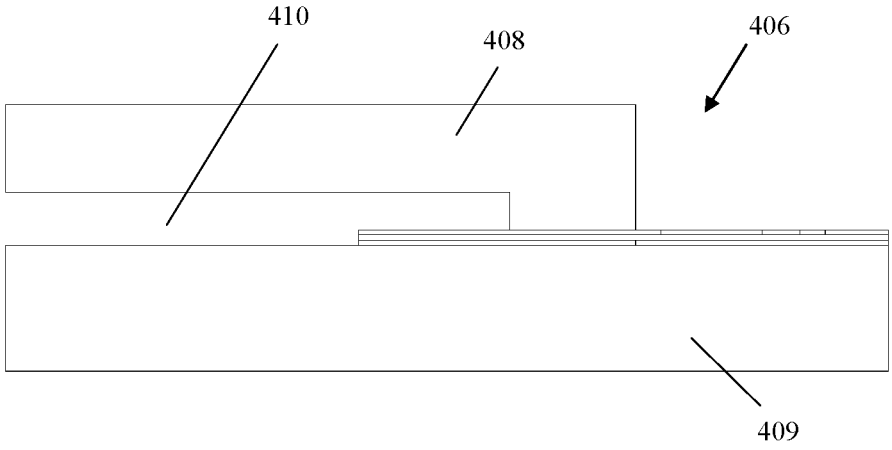
FIG. 4*b* is a side view of the head2 connector in FIG. 4*a*.
Figure 5:
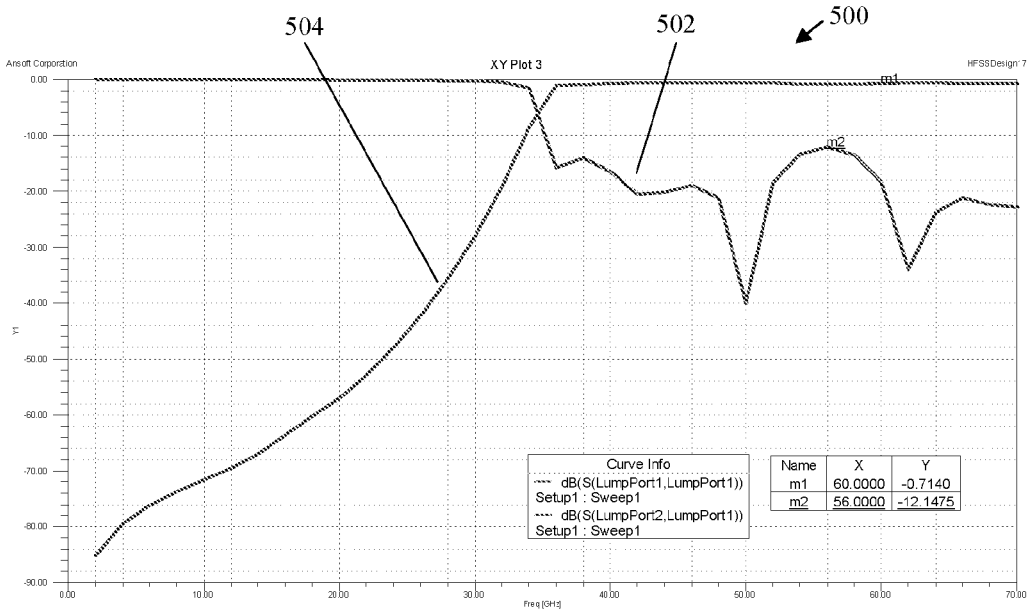
FIG. 5 is a graph of simulation results of the second example embodiment.

The head2 406 is shown in more detail in FIG. 4*b*. The head2 406 and is sandwiched between two sheaths 408,409 with an open slot 410 at one side. The two heads 402,406 may be permanently connected to a transmitter or a receiver. The sheaths 408,409 and may be attached by glue or other mechanical attachment, such as screws, to the SIW portion of each head.

Metal patches 412,413 cover and extend from both ends of the middle 404 part. Each end of the middle part 404 and the metal patches 412,413 plug into the slot 410. When the middle 404 is plugged in the slot 410, the metal patch 412 is electrically connected between the top metal layer of both the head2 406 and the middle 404. This ensures there is no gap between the top metal layer of the head2 406 and the middle 404, so that the current becomes coherent inside the SIW. Similarly the bottom sheath 409 may also be metal, and electrically connect between the bottom metal layer of both the head2 406 and the middle 404. The top sheath 408 may either be plastic or metal, since its main purpose is mechanical engagement with the middle 404. The middle 404 may be inserted from the side of the slot 410 or bent (to temporarily shorten it) and then inserted from the end of the slot 410.

The middle 404 may be fabricated on a flexible substrate material or a rigid substrate. Since the both top and bottom layers of the SIW 400 are metal, the electric field is in limited inside the substrate and there is almost no radiation when the SIW 400 is bent.

Typically the head1 402 and the head2 406 will be permanently connected to a transmitter or receiver. The transmitter or receiver will typically include a MSL type transmission channel. Thus the second embodiment includes a MSL-SIW interface 416. Because the MSL 416 transmits in TEM mode, part of the transmission medium is the air surrounding the MSL, opposite the ground plane. Thus the MSL may not efficiently transfer signals if it were covered by the sheath 408. Also an uncovered structure may be more convenient for connection to the transmitter or receiver connector. Thus desirably the bottom sheath 409 may extend to the end of the head2 406, whereas the top sheath 402 may extend just short of the MSL-SIW interface 416 so that it is uncovered. Alternatively if the top sheath 402 is a dielectric, it may cover the MSL-SIW interface 416.

The MSL-SIW interface 416 should impedance match and field match between the MSL and the SIW. Impedance matching may be established using MSL tapering 418. Field matching may be achieved using a rectangular slot 420 on the end of the top metal layer of SIW. This slot 420 surrounds the MSL tapering 418, reduces the leakage of the MSL 416 E-field and improves the E-field matching.

FIG. 4 shows the bandwidth 502 can be over several tens of GHz and the insertion loss 504 is less than 1 dB with total channel length equal to 8.8 mm.

While example embodiments of the invention have been described in detail, many variations are possible within the scope of the invention as will be clear to a skilled reader.

The invention claimed is:

1. A signal transmission channel comprising:

a substrate integrated waveguide configured for use as a signal transmission channel;

a first interface configured to connect with receiver microstrip lines, the first interface including a first tapered portion and a first slot surrounding the first tapered portion;

a second interface configured to connect with transmitter microstrip lines, the second interface including a second tapered portion and a second slot surrounding the second tapered portion; and an upper sheath and a lower sheath configured to connect the substrate integrated waveguide and the first interface and/or the second interface, the upper sheath at least partially extending toward the lower sheath to form a portion of at least one open slot, the substrate integrated waveguide at least partially received within the at least one open slot, wherein the lower sheath extends up to an end portion of the transmitter microstrip lines, and the upper sheath extends to partially receive the transmitter microstrip lines.

2. The signal transmission channel claimed in claim 1, wherein the substrate integrated waveguide is flexible.

3. The signal transmission channel claimed in claim 2, wherein the substrate integrated waveguide comprises a liquid-crystal polymer substrate.

4. The signal transmission channel claimed in claim 1, wherein the signal transmission channel is configured for millimeter-wave signals.

5. The signal transmission channel claimed in claim 1, wherein the upper and lower sheaths are made of different materials.

6. The signal transmission channel claimed in claim 1, wherein the substrate integrated waveguide is only partially received within the at least one open slot.

7. The signal transmission channel claimed in claim 1, wherein at least one of the upper and lower sheaths electrically connects portions of the substrate integrated waveguide.

8. The signal transmission channel claimed in claim 1, wherein only one of the upper and lower sheaths extends to an end portion of the substrate integrated waveguide.

9. The signal transmission channel claimed in claim 1, wherein the substrate integrated waveguide further comprises a top metal layer and a bottom metal layer.

10. The signal transmission channel claimed in claim 1, further comprising a metal patch that plugs into the at least one open slot to connect a head portion of the substrate integrated waveguide with a middle portion of the substrate integrated waveguide.

11. The signal transmission channel claimed in claim 1, wherein the substrate integrated waveguide further comprises a rectangular slot on end of a top metal layer of the substrate integrated waveguide.

12. A signal transmission channel comprising:

a first connector configured to interface with receiver microstrip lines;

a second connector configured to interface with transmitter microstrip lines;

a substrate integrated waveguide removably connectable between the first connector and the second connector; and an upper sheath and a lower sheath configured to connect the substrate integrated waveguide and the first connector and/or the second connector, the upper sheath at least partially extending toward the lower sheath to form a portion of at least one open slot, the substrate integrated waveguide at least partially received within the at least one open slot, wherein the lower sheath extends up to an end portion of the transmitter microstrip lines, and the upper sheath extends to partially receive the transmitter microstrip lines.

13. The signal transmission channel claimed in claim 12, wherein the substrate integrated waveguide abuts the first connector and the upper and lower sheaths sandwich the abutment.

14. The signal transmission channel claimed in claim 13, wherein the substrate integrated waveguide further comprises a metal patch configured to electrically connect a signal conduction path between the substrate integrated waveguide and the first connector and/or the second connector.

15. The signal transmission channel claimed in claim 12, wherein the upper and lower sheaths are made of different materials.

16. The signal transmission channel claimed in claim 12, wherein the substrate integrated waveguide is only partially received within the at least one open slot.

17. The signal transmission channel claimed in claim 12, wherein at least one of the upper and lower sheaths electrically connects portions of the substrate integrated waveguide.

18. The signal transmission channel claimed in claim 12, wherein only one of the upper and lower sheaths extends to an end portion of the substrate integrated waveguide.

* * * * *